United States Patent [19]

Mitch et al.

[11] Patent Number: 4,557,952

[45] Date of Patent: Dec. 10, 1985

[54] PROCESS FOR CONTROLLING ZINC VAPOR IN A FINISHING PROCESS FOR A HOT DIP ZINC BASED COATING ON A FERROUS BASE METAL STRIP

[75] Inventors: David S. Mitch, Fairfield; Lloyd W. Abrams, Gratis; Jerry L. Arnold, Franklin; Forrester Caudill, Middletown; Thomas A. Compton, Middletown; Steven L. Boston, Middletown, all of Ohio

[73] Assignee: Armco Inc., Middletown, Ohio

[21] Appl. No.: 635,512

[22] Filed: Jul. 30, 1984

[51] Int. Cl.[4] ..... B05D 1/18

[52] U.S. Cl. ..... 427/432

[58] Field of Search ..... 427/329, 383.7, 432, 427/433

[56] References Cited

U.S. PATENT DOCUMENTS

| | | | |
|---|---|---|---|
| 4,053,663 | 10/1977 | Caldwell | 427/432 |
| 4,183,983 | 1/1980 | Cook | 427/433 |
| 4,330,574 | 5/1982 | Pierson | 427/432 |
| 4,369,211 | 1/1983 | Nitto | 427/433 |
| 4,444,814 | 3/1984 | Flinchum | 427/432 |

FOREIGN PATENT DOCUMENTS 847940 3/1980 Belgium .

OTHER PUBLICATIONS

Heurtey-English Abstract Of Belgian Pat. No. 887,940 filed 3/14/80.

*Primary Examiner*—Sam Silverberg

*Attorney, Agent, or Firm*—Frost & Jacobs

[57] ABSTRACT

A process for controlling zinc vapor in a finishing process for a hot dip zinc based coating on a ferrous base metal strip in which the strip emerges from the coating bath into an enclosed chamber, by injecting high dew point gas into the chamber. The process is applicable on both a one side and two side coating process. Preferably the atmosphere has about 1-3% water vapor, by volume, for both one-sided and two-sided process.

17 Claims, 4 Drawing Figures

PROCESS FOR CONTROLLING ZINC VAPOR IN A FINISHING PROCESS FOR A HOT DIP ZINC BASED COATING ON A FERROUS BASE METAL STRIP

TECHNICAL FIELD

This invention relates to a finishing process for a hot dip zinc based coating on a ferrous base metal strip, and more particularly to controlling zinc vapor formation in an enclosed coating chamber, by injecting high dew point atmosphere into the coating chamber.

The present application is co-pending with U.S. patent application Ser. No. 635,512, titled "Process For Controlling Snout Zinc Vapor In A Hot Dip Zinc Based Coating On A Ferrous Base Metal Strip" (commonly assigned).

BACKGROUND ART

Essentially there are two major galvanizing processes in which a ferrous base metal strip is hot dipped into a molten zinc base metal. These two major galvanizing processes are referred to as the "Sendzimir" process and the "non-oxidizing" process.

In the "Sendzimir" process (see U.S. Pat. No. 2,110,893 to Sendzimir), a ferrous base metal strip is first introduced into an oxidizing furnace, which burns off any oil or organic material on the strip, and simultaneously oxidizes the strip to form a surface coating of metal oxide (primarily ferrous oxide). Next, the ferrous base metal strip is introduced into an enclosed, sealed, reducing furnace, which reduces the oxides on the surface of the strip, leaving a cleaned strip which is maintained in an enclosed snout containing a protective reducing atmosphere generally including hydrogen, and nitrogen and/or other inert gases. Lastly, the ferrous base metal strip is hot dipped in a molten zinc based coating bath in which the excess zinc based coating on the exiting strip is removed by a pair of wiping or coating rolls, generally positioned at or slightly above the molten coating bath surface.

A "non-oxidizing" process is taught in U.S. Pat. No. 3,320,085 assigned to the Selas Corporation. Any oil or dirt on the ferrous base metal strip is removed by a washing or pickling process, followed by a water rinse, which leaves a substantially invisible oxide film on the surface of the strip. The ferrous base metal strip is then introduced into a reducing furnace to remove the oxide coating. The reducing furnace is heated by the direct combustion of fuel and air to a temperature of at least 2400° F., wherein the combustion atmosphere has no free oxygen and at least 3% excess combustibles. From the direct combustion furnace, the cleaned ferrous base metal strip is generally maintained in an enclosed snout containing a protective atmosphere such as hydrogen, nitrogen or other inert, non-oxidizing gases. Lastly, the ferrous base metal strip is hot dipped in a molten zinc based coating bath in which the excess zinc based coating on the exiting strip is removed by a pair of wiping or coating rolls, generally positioned at or slightly above the molten coating bath surface. Several major problems are encountered with these prior art galvanizing processes. The most important problem area is that of coating control of the ferrous base metal strip including non-uniform coating, edge berries, spangled relief, and feathered oxides.

Except for the portion of the surface of the molten zinc base bath which is within the enclosed snout, the remainder of the molten metal surface is ordinarily exposed to the atmosphere in the prior art processes. Accordingly, a layer of dross, which is primarily zinc oxide, is formed on the exposed portion of the molten metal surface. The dross is a metal oxide characterized by bits of flaky solid material.

Bits of dross are picked-up by the ferrous base metal strip, particlarly at the end edges of the strip, as the strip exits the molten metal coating pot. The bits of dross are called edge berries.

Edge berries cause two problems. The first problem concerns those edge berries which are not removed from the strip by the coating rolls, and thus end up on the galvanized strip. The second problem concerns those edge berries which are transferred from the ferrous base metal strip to the coating rolls, thus yielding a non-uniform coating on the strip for each revolution of the coating rolls caused by the non-uniform surface of the coating rolls.

Edge berries were greatly diminshed by the use of jet finishing knives in place of the wiping rolls as taught in U.S. Pat. No. 4,137,347. The jet finishing knives may be positioned about 0.5 to 4.0 feet above the surface of the molten zinc base metal bath, and direct pressurized air at both sides of the ferrous base metal strip. As the bits of dross are picked-up by the strip, the jet finishing knives sweep away the excessive coating and most of the bits of dross or edge berries. Nevertheless, some edge berries still adhere to the ferrous base metal strip, causing the previously mentioned first problem.

A spangle is a zinc crystal usually easily visible on some galvanized ferrous base metal strips. Spangle relief concerns both the variation in zinc thickness across the zinc crystal and a depressed spangle boundary which surrounds each crystal. Thus, a non-uniform thickness or coating results if the spangles are prevalent and large in size. Spangle relief can be greatly eliminated by permitting the iron and zinc to alloy, forming a galvanized strip whose inner layer is iron, and an intermediate layer of alloyed iron and zinc, with an outer layer of zinc. However, both zinc and iron are ductile, while an iron-zinc-alloy is brittle. Accordingly, the brittle layer may flake-off the ductile iron layer if the alloy layer is too thick and is work-stressed, such as by sharp bending.

Another procedure to reduce spangle relief is to add antimony to the molten zinc base metal which changes the crystal morphology, resulting in smaller crystals, thereby minimizing the size of the spangle and resulting in a more uniform thickness of the spangle. However, neither of these methods is entirely satisfactory because the results are not consistent.

If the ferrous base metal strip is pulled through the jet finishing knives at low speeds, care must be taken to avoid causing the zinc metal to oxidize, thus forming a metal oxide film on the coating surface. This problem is termed "feathered oxides" because they appear like feathers which extend inwardly toward the center of the strip.

These problems of non-uniform coating, edge berries, spangle relief and feathered oxides were cured by maintaining a non-oxidizing or inert gas atmosphere within a coating chamber mounted around and above where the ferrous base metal strip exits from the surface of the molten coating. Molecular oxygen is maintained at less than 1000 ppm in the coating chamber (see U.S Pat. No. 4,330,574 to Pierson et al). For best results, the molecular oxygen was maintained at below 100 ppm within the coating chamber, and preferably below 50 ppm. By employing a non-oxidizing or inert gas for the jet finishing knives, and surrounding the freshly coated strip and jet finishing knives with a coating chamber, a positive pressure can be maintained within the chamber, which will prevent the formation of zinc oxides as dross, edge berries and feathered oxides. Furthermore, for some unexplained reason, spangle relief is greatly diminished and the spangles are much more uniform in size and thickness.

A non-oxidizing or inert gas has also been employed in a one side coating process of a ferrous base metal strip as exemplified by U.S. Pat. No. 4,114,563 to Schnedler et al. As disclosed therein, the uncoated strip travels sufficiently close to the surface of the molten metal to cause the formation of a meniscus which continuously contacts and coats one side of the ferrous base metal strip. Once one side of the strip is coated, a jet finishing knife is employed to remove the excessive coating. The strip, both before and immediately after being coated, is protected by an enclosure maintained with a positive pressure of non-oxidizing or inert gas. After coating, the strip preferably remains in the enclosure until it has sufficiently cooled and solidified to prevent the coating from oxidizing before it bonds with the strip.

U.S. Pat. No. 3,383,250 teaches a coating process wherein one side of the ferrous base metal strip is oxidized, which prevents the coating material from adhering to the oxidized side. The strip is totally submerged in the molten metal to yield a one side coated strip. Subsequently, the strip is subjected to a cleaning procedure to remove oxide on the uncoated side of the strip.

It is also known that one side of the ferrous base metal strip can be physically or chemically masked (other than by oxidation) such as by employing a film of calcium base slurry. The strip is then totally submerged to coat the unmasked side and subsequently the physical or chemical mask is removed.

Although the non-oxidizing or inert gas atmosphere in the coating chamber solves the many problems previously mentioned, a severe new problem developed when using a process like the Pierson et al or Schnedler et al process. That problem is the undesirable formation of zinc vapor. The zinc vapor leaks from the coating chamber and creates a potentially adverse environmental condition. The vapor condenses and "zinc dust" coats the surrounding work area.

It is theorized that the reduction of oxygen in the Pierson et al or Schnedler et al process results in zinc vapor becoming the dominant partial vapor pressure within the coating chamber, thus substantially increasing the formation of zinc vapor. The following two prior art references recognize the problem of zinc vapor formation and attempted to reduce its escape into the work environment:

U.S. Pat. No. 4,369,211 to Nitto et al recognizes the zinc vapor problem and proposes a solution to zinc vaporization by maintaining an oxygen controlled atmosphere from 50 to 1000 parts per million in the coating chamber to diminish or eliminate the zinc vapor formation. Also, Nitto et al state that it is essential that the zinc base alloy coating contain 0.1 to 2% by weight magnesium to inhibit surface corrosion on a coated metal strip. It is theorized that molten magnesium in the hot dip coating may exert some influence upon the formation of zinc vapor, once a low oxidizing-potential atmosphere has been achieved, and consequently, it is alleged that both the magnesium in the hot dip coating, and the maintenance of a minimal amount of molecular oxygen in the atmosphere of the coating chamber help reduce or eliminate the formation of the zinc vapor.

For high speed coating lines the process of Nitto et al is insufficient because steady-state conditions are difficult to maintain by controlling the atmosphere within the coating chamber from 50 to 1000 ppm. Although some improvement in controlling zinc vapor formation may exist, substantial zinc vapor continues to form and create the previously described coating and environmental conditions.

Belgion Pat. No. 887,940 to Heurtey also recognizes the formation of the zinc vapor in the entry section to the coating pot. It eliminates the passage of zinc vapor into the cooling and furnace equipment which are positioned before the coating pot by employing a sweep gas which sweeps over the hot dip bath surface, becoming loaded with the coating metal vapor, and is then evacuated and further treated to condense the coating metal, thus preventing the transfer of the zinc vapor to other parts of the installation. This patent does not attempt to control the zinc vapor formation by any particular atmosphere and moreover, it does not control the zinc vapor formed within the coating chamber.

Because the Nitto et al process is insufficient for high speed coating and requires the addition of magnesium in the coating pot, and because the Belgian process is not practical in that additional equipment necessary to extract the zinc vapor from the sweep gas is required, there is a need for controlling the atmosphere within the coating chamber that is both inexpensive, requiring simple equipment, and operable by a minimally skilled technician.

SUMMARY OF THE INVENTION

The present invention is based upon the discovery that formation of zinc vapor in the coating chamber of a hot dip zinc coating on a ferrous base metal strip can be controlled by injecting a high dew point atmosphere into the coating chamber, which suppresses the formation of zinc vapor.

The present invention employs steam or wet gases such as nitrogen, hydrogen or inert gases, or a mixture of these, having sufficent dew point to suppress zinc vapor formation. For a two-sided coating process, it is preferred that the present process employ 1 to 3% water vapor in the coating chamber atmosphere, which is 10,000 to 30,000 parts per million, and corresponds to a dew point of about 50° F. to about 75° F.

For a one-sided coating process, the preferred coating chamber atmosphere is the same as for two-sided coating but the make up water to maintain the atmosphere will be about ½ that required for a two-sided coating process.

In the broadest sense, the present invention is directed to a process for continuously coating a ferrous base metal strip with a molten zinc based metal wherein the strip is enclosed immediately after coating, comprising: injecting and maintaining sufficient water vapor in the enclosure to suppress zinc vapor formation.

The process of the present invention will be more fully disclosed in the following description.

DESCRIPTION OF THE PREFERRED EMBODIMENTS

Figure 1:
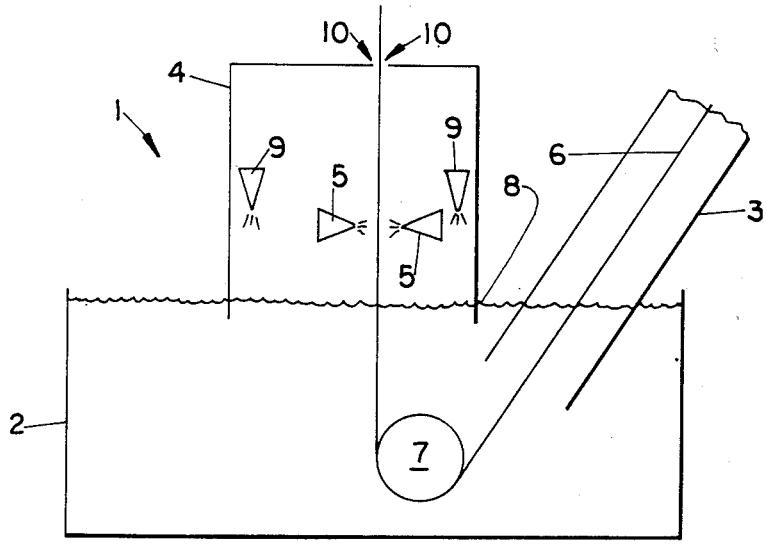
FIG. 1 shows a cross sectional side view of a two sided coating process including an enclosed coating chamber with a ferrous base metal strip being hot dipped in the molten coating.

FIG. 1 shows an embodiment of the invention of the present application wherein reference numeral 1 generally indicates typical coating apparatus. It includes a coating pot 2, an entrance snout 3 and a coating chamber 4. The ferrous base metal strip 6 enters the coating pot 2 via the entrance snout 3 and is hot dipped into a molten zinc base metal whose liquid level is illustrated by reference numeral 8. The ferrous base metal strip is coated on both sides as it traverses around roller 7, and exits from pot 2 between a pair of jet finishing nozzles 5, which are positioned in the coating chamber, all of which is well known and disclosed in U.S. Pat. No. 4,330,574.

Reference numeral 9 represents pipes illustrated as positioned slightly above jet finishing nozzles 5 and above the molten metal adjacent the walls of the coating chamber 4. The pipes 9 direct wet gas downwardly which suppresses the formation of zinc vapor within coating chamber 4. The water vapor, which preferably represents about 1 to about 3% of the total volume of gases within the chamber of this illustration, supresses the formation of the zinc vapor by reacting the zinc vapor with water vapor to form zinc oxide and hydrogen gas ($Zn+H_2O \rightarrow ZnO+H_2$).

Without the introduction of wet gases, the zinc vapor would typically fill the coating chamber. It would leak into the working environment through slot 10 and would condense, partially oxidize, and coat the surrounding work environment with metallic zinc and zinc oxide dust. By exercising the process of the present invention, the coating continues very uniform, smooth and glossy because the injection of steam or wet gas inhibits or eliminates the zinc vapor formation without disturbing the coating.

It is within the scope of the invention to position pipe 9 anywhere within coating chamber 4, as long as sufficient water vapor exists to suppress the formation of zinc vapor.

Although two pipes are illustrated, one or more pipes could be employed, and while the number of pipes is not important, it is important to provide sufficient water vapor within coating chamber 4 to prevent zinc vapor from leaking into the surrounding environment. Once the strip has been finished by nozzles 5, it is important not to disturb the molten coating as it exits from the coating chamber and cools. Otherwise, disturbance of the molten coating may give rise to defects in the coating.

In operation of the FIG. 1 apparatus, the ferrous base metal strip 6 enters coating pot 2, through entrance snout 3 from a furnace (not shown), which typically heats the ferrous base metal strip to a temperature of about 1000° F. to as high as 1650° F., and is then cooled to approximately 860° F. just before entering entrance snout 3. The ferrous base metal strip submerges into the molten zinc base metal, which coats both sides of the strip, and is directed by roller 7 toward the coating chamber. As the ferrous base metal strip emerges from the molten bath surface, a pair of jet finishing nozzles 5 direct a jet of non-oxidizing gas, such as nitrogen, upon both sides of the ferrous base metal strip which serves to prevent the development of edge berries, feathered oxides and spangle relief, in addition to providing a uniform coating on the ferrous base metal strip, before it exits from the coating chamber. Steam or wet gas is introduced into chamber 4 through pipe 9 so as to maintain a preferred atmosphere having about 1–3%, by volume, water vapor. From 1.2 to 2.9% water vapor by volume (+50° to +75° F. dew point) is the more preferred range.

The above operation of the FIG. 1 apparatus is directed to two-sided coating. However, the same operation can be employed for a one-sided coating, if one side of the ferrous base metal strip 6 is physically or chemically masked before it enters the entrance snout 3, as is well known to those skilled in the art. By masking one side, only the remaining side is coated with the zinc base metal. Later, the mask is removed by techniques well known to those skilled in the art.

With a one-sided coating process, less water vapor is required because less zinc vapor is formed. Formation of zinc vapor is directly related to the total surface area of exposed molten metal per unit of time. The majority of total surface area per unit of time is the surface area of the coated ferrous base metal strip. By coating one side of the ferrous base metal strip, less coated surface area of the base metal strip is available to cause zinc vapor formation. Therefore, a one-sided coating process requires about ½ of the water of the two-sided coating process.

Figure 2:
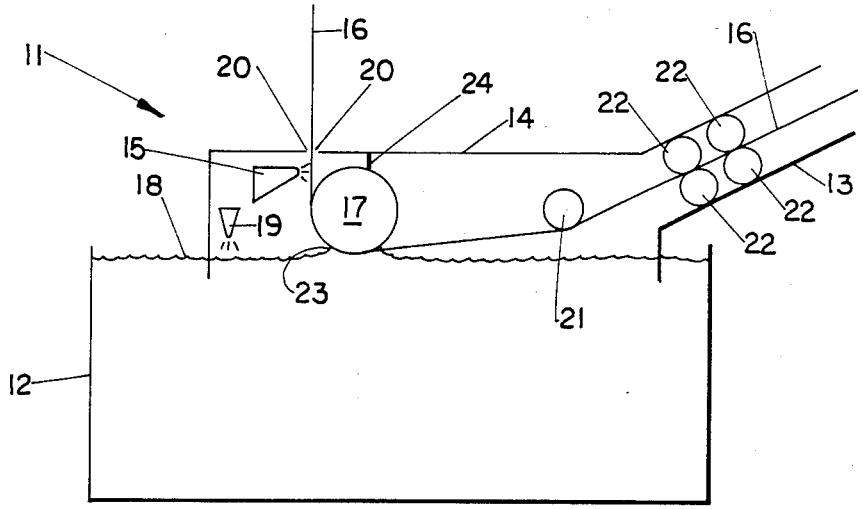
FIG. 2 shows a cross sectional side view of a one-sided process including an enclosed coating chamber with one side of a ferrous base metal strip being in contact with a meniscus of the molten coating.
Figure 3:
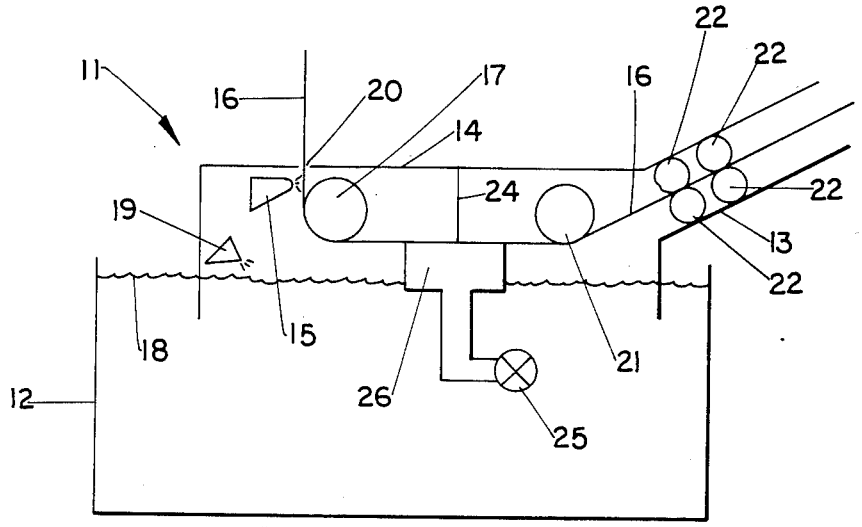
FIG. 3 shows a cross sectional side view of another one-sided process including an enclosed coating chamber with one side of the ferrous base metal strip being contacted by the molten coating.
Figure 4:
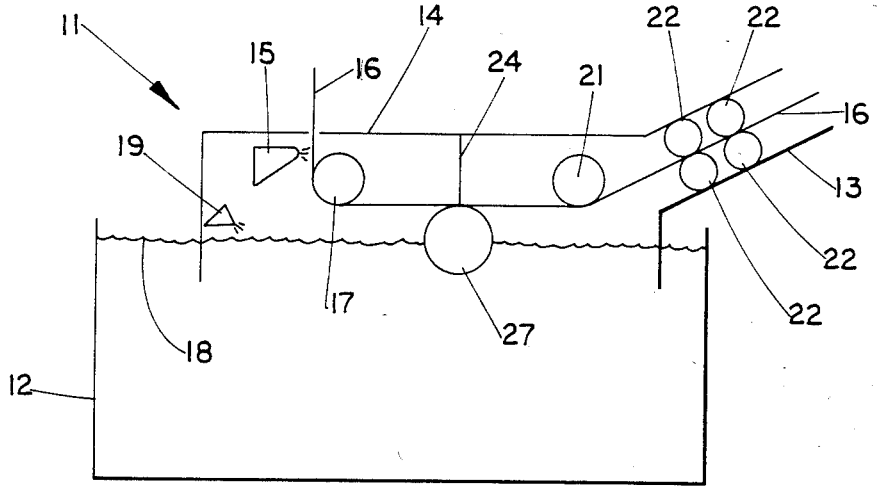
FIG. 4 shows a cross sectional side view of another one-sided process including an enclosed coating chamber with one side of the ferrous base metal strip being coated with molten coating applied by an applicator roll.

In regard to FIGS. 2–4, reference numeral 11 illustrates additional modification of the one-side coating process. As is described with respect to FIG. 1, reference numeral 12 represents a coating pot containing molten zinc base metal with a surface 18. The ferrous base metal strip 16 enters the coating chamber 14 from entrance snout 13. Two pairs of sealing rolls 22 seal the entrance snout 13 from the coating chamber 14, to prevent water vapor from entering snout 13. Roller 21 redirects the ferrous base metal strip 16 such that it traverses a more nearly horizontal path. Jet finishing nozzle 15 directs an inert gas toward coated strip 16, performing the jet finishing function of removing excess coating. Roller 17 directs the ferrous base metal strip through slot 20 in the top of coating chamber 14. All the above parts of FIG. 2 are illustrated and described in U.S. Pat. No. 4,114,563 to Schnedler et al.

With respect to FIG. 2, a meniscus 23 is formed below roller 17, thus permitting the molten metal to contact the ferrous base metal strip.

With respect to FIG. 3, the meniscus of FIG. 2 is replaced by a submersible pump 25 which pumps molten metal up to reservoir 26, which overflows with molten metal as the molten metal contacts and coats one side of ferrous metal strip 16.

With respect to FIG. 4, the meniscus of FIG. 2 is replaced by an applicator roll 27, which is partially submerged in the molten metal. As applicator roll 27 rotates, one side of the ferrous base metal strip 16 is coated.

Pipe 19 is illustrated as positioned adjacent the side wall of the coating chamber enclosure 14 adjacent ferrous base metal strip 16, as described with respect to FIG. 1. Of course, multiple pipes could be employed and positioned anywhere within coating chamber 14. A sealing device 24 prevents oxidizing atmosphere, introduced by pipe 19, from contacting the surface of the ferrous base metal strip prior to coating thereof, which would prevent good adherence of the molten coating.

As the ferrous base metal strip enters coating chamber 14 from snout 13, a roller 21 diverts the path of the strip to a more nearly horizontal direction in order to coat one side of the strip by contacting the strip with an applicator roll, or by spraying the molten metal or by raising a meniscus below roller 17. By continuously contacting and coating one side of the strip, the necessity of dipping or submerging the strip into the molten zinc base metal as shown and described in the operation of the FIG. 1 device is avoided. Roller 17 directs the strip upwardly past nozzles 15 and 19, whereby strip 16 exits the coating chamber 14 through slot 20.

Sealing device 24 can be eliminated if a non-oxidizing atmosphere issues from pipe 19. For example, a copending U.S. patent application Ser. No. 635,512 filed concurrently herewith and entitled "Process for Controlling Snout Zinc Vapor in a Hot Dip Zinc Based Coating on a Ferrous Base Metal Strip" (commonly assigned) describes a non-oxidizing gas which comprises at least a 4 to 1 ratio of hydrogen to water vapor, and preferably a 6 to 1 ratio. However, it is also important not to form an atmosphere having greater than about 4% hydrogen, because such an atmosphere would be within the flash point composition, causing automatic flashing of the atmosphere.

A typical one- or two-sided coating process requires 1–3% water vapor in the coating chamber atmosphere. To make a non-oxidizing coating chamber atmosphere, at least a 4 to 1 hydrogen to water vapor ratio must be maintained, if the sealing device is to be eliminated. However, less makeup water vapor maintained in the coating chamber atmosphere is required in the one-sided coating process as compared to the two-sided process. All things being constant, less makeup water vapor is required because less coated surface area is exposed to the atmosphere per unit of time. This means that per unit of time less water vapor is consumed in suppressing zinc vapor formation.

If water vapor is maintained below about 1%, by volume in the coating chamber, zinc vapor formation will be suppressed but not to the extent that a 1–3% by volume of water vapor would provide. The leakage of zinc vapor into the surrounding environment through slot 10 or 20 may still be evident.

Of course, the amount of water vapor needed to suppress zinc vapor formation, depends largely on the fresh zinc coated surface area, as discussed previously, which may vary from application to application. On the other hand, maintaining the water vapor within the coating chamber beyond about 3%, by volume, causes dross formation on the exposed surface of the molten zinc base metal in the chamber, and dross particles may attach to the coated strip and cause edge berries. Consequently, it is preferable to maintain the water vapor within about 1% to about 3%, by volume.

The following examples further illustrate the features and characteristics of the present invention. In the following examples, the term "zinc vapor" is used to describe the visible zinc emissions from the coating chamber.

EXAMPLE 1

Nitrogen gas was injected through each nozzle 5, as shown in FIG. 1, onto the ferrous base metal strip which had been hot dip coated in a zinc or zinc base alloy coating. The strip width was 37 inches, the line speed was 100 feet per minute and the slot opening 10 was 3½ inches. The coating chamber contained 15 ppm molecular oxygen. Steam was not injected into the coating chamber. The atmosphere measured −40° F. dew point with the ALNOR dew point instrument. While the coated ferrous base metal strip had no edge berries, feathered oxides or spangled relief, heavy zinc vapor was produced yielding a zinc oxide dust when Zn and ZnO leaked and condensed in the surrounding environment. This example illustrates the typical operating procedure described in U.S. Pat. No. 4,330,574.

EXAMPLE 2

The nitrogen gas flow rate of Example 1 was maintained and the coating chamber contained 40 ppm molecular oxygen. The strip width was 70 inches, the line speed was 210 fpm and the slot opening was 2 inches. Steam was introduced into the chamber at 10–20 psi. This resulted in the atmosphere having a dew point of +20° F. (3436 parts per million of water vapor). The coated ferrous base metal strip contained no edge berries, feathered oxides, or spangled relief. The zinc vapor was of medium density as compared to the heavy density of Example 1. While some zinc vapor leaked and condensed in the surrounding environment, the amount was not as evident as with Example 1.

EXAMPLE 3

Nitrogen gas was again injected through nozzles 5 and 20–30 psi steam was injected through pipe 9 resulting in an atmosphere having a dew point of +38° F. (7620 parts of water vapor per million), and 78 parts per million molecular oxygen. The strip width was 58 inches, the line speed was 240 fpm and the slot opening was 2 inches. A coated metal strip containing no edge berries, feathered oxides or spangled relief was obtained, but a light density zinc vapor was produced.

EXAMPLE 4

Nitrogen gas was again injected through nozzles 5 in the coating chamber and 40–100 psi steam was injected through pipe 9 resulting in an atmosphere having a dew point of +60° F. (17425 parts per million or 1.74% water), and containing 150 part per million molecular oxygen. The strip width was 70 inches, the line speed was 251 fpm and the slot opening was 2 inches. A coated ferrous base metal strip having no edge berries, feathered oxides or spangled relief was obtained and produced no zinc vapor.

EXAMPLE 5

Nitrogen gas was introduced through nozzles 5 and 10–20 psi steam was injected through pipe 9 resulting in a coating chamber atmosphere having a dew point of +62° F. and having 600 ppm molecular oxygen. The strip width was 52 inches, the line speed was 300 fpm and the slot opening was 2 inches. A coated metal strip was produced containing no edge berries, feathered oxides or spangled relief. Light density zinc vapor was produced.

EXAMPLE 6

While nitrogen gas was injected through nozzles 5 in the coating chamber, 10–20 psi steam was injected through nozzles 9 producing an atmosphere in the coating chamber having a +65° F. dew point and 450 ppm molecular oxygen. The strip width was 48 inches, the line speed was 230 fpm and the slot opening was 2 inches. A coated metal strip containing no edge berries, feathered oxides or spangled relief was obtained. A light density zinc vapor was produced.

EXAMPLE 7

Nitrogen gas was injected through nozzles 5 while 10–20 psi steam was injected through nozzles 9 producing a dew point of +72° F. in the coating chamber with 55 ppm molecular oxygen. The strip width was 52 inches, the line speed was 300 fpm and the slot opening was 2 inches. A coated metal strip containing no edge berries, feathered oxides or spangled relief was obtained. A light denisty zinc vapor was produced.

EXAMPLE 8

While nitrogen gas was injected through nozzles 5, a 10–20 psi steam was injected through nozzles 9 producing an atmosphere within the coating chamber having a +65° F. dew point with 55 ppm molecular oxygen. The strip width was 52 inches, the line speed was 300 fpm and the slot opening was 2 inches. A coated metal strip was obtained containing no edge berries, feathered oxides or spangled relief. A light density zinc vapor was produced.

EXAMPLE 9

Steam was injected through pipe 9 at 22–35 psi while nitrogen gas was injected through nozzles 5. The atmosphere within the coating chamber contained a dew point of +29° F. and 54 ppm molecular oxygen. The strip width was 60 inches, the line speed was 282 fpm and the sot opening was 2½ inches. A coated metal strip containing no edge berries, feathered oxides or spangled relief was obtained. A light density zinc vapor was produced.

EXAMPLE 10

As oxygen gas was injected through nozzles 5, a 20–30 psi steam was injected through pipe 9 producing an atmosphere containing a +40° F. dew point with 60 ppm molecular oxygen. The strip width was 70 inches, the line speed was 260 fpm and the slot opening was 2 inches. A coated metal strip was obtained containing no edge berries, feathered oxides or spangled relief. A light density zinc vapor was produced.

EXAMPLE 11

While nitrogen was injected through nozzles 5, a 10–30 psi steam was injected through pipe 9 producing a +37° F. dew point and molecular oxygen at 150 ppm. The strip width was 70 inches, the line speed was 225 fpm and the slot opening was 2 inches. A coated metal strip containing no edge berries, feathered oxides or spangled relief was obtained. A medium density zinc vapor was produced.

EXAMPLE 12

Nitrogen gas was again injected through nozzles 5 in the coating chamber while a 10–20 psi steam was injected through pipe 9 producing an atmosphere within the coating chamber having a +42° F. dew point. The strip width was 70 inches, the line speed was 225 fpm and the slot opening was 2 inches. A coated metal strip was obtained containing no edge berries, feathered oxides or spangled relief. A light density zinc vapor was produced.

EXAMPLE 13

While nitrogen gas was introduced into the coating chamber through nozzles 5, a 10–20 psi steam was introduced into the chamber through pipe 9 producing an atmosphere within the coating chamber having a +23° F. dew point. The strip width was 70 inches, the line speed was 275 fpm and the slot opening was 2½ inches. A coated metal strip containing no edge berries, feathered oxides or spangled relief was obtained. A light density zinc vapor was produced.

EXAMPLE 14

As nitrogen gas was introduced into nozzle 5, a 10–30 psi steam was introduced into the coating chamber through pipe 9 producing a +20° F. dew point having 23 ppm molecular oxygen. The strip width was 64 inches, the line speed was 175 fpm and the slot opening was 2½ inches. A quality coated metal strip was obtained having none of the prior problems. No zinc vapor was visibly detected by the naked eye.

EXAMPLE 15

As nitrogen gas was injected through nozzle 5, a 10–30 psi steam was injected into the coating chamber through pipe 9 producing a +30° F. dew point having 23 ppm molecular oxygen. The strip width was 64 inches, the line speed was 175 fpm and the slot opening was 2½ inches. A coated metal strip containing none of the prior art problems was obtained. No zinc vapor was visible to the naked eye.

EXAMPLE 16

Nitrogen gas was injected into the coating chamber through nozzle 5, a 60 psi steam was injected through pipe 9 producing a +50° F. dew point having 12 ppm molecular oxygen. The strip width was 37 inches, the line speed was 270 fpm and the slot opening was 1¾ inches. A coated metal strip containing no edge berries, feathered oxides or spangled relief was obtained. A light density zinc vapor was produced.

EXAMPLE 17

As nitrogen gas was injected into the coating chamber through nozzles 5, a 20–30 psi steam was injected through pipe 9 producing a +25° F. dew point having 20 ppm molecular oxygen. The strip width was 37 inches, the line speed was 270 fpm and the slot opening was 1¾ inches. A coated metal strip having none of the prior art problems was produced. A medium density zinc vapor was visible.

EXAMPLE 18

While nitrogen gas was introduced into the coating chamber through nozzles 5, a 20–40 psi steam was introduced into the coating chamber through a pipe 9 producing a +60° F. dew point having 100 ppm molecular oxygen. The strip width was 61 inches, line speed was 300 fpm and the slot opening was 2½ inches. A coated metal strip was obtained containing no edge berries, feathered oxides or spangled relief. A very light density zinc vapor was produced.

EXAMPLE 19

As nitrogen gas was introduced through nozzles 5 into the coating chamber, a 20–40 psi steam was introduced through pipe 9 producing a +65° F. dew point having 90 ppm molecular oxygen. The strip width was 61 inches, the line speed was 300 fpm and the slot opening was 3 inches. A coated metal strip having none of the prior art problems was produced. A light density zinc vapor was visible to the naked eye.

EXAMPLE 20

As nitrogen gas was introduced through nozzles 5 a 20–40 psi steam was introduced into the coating chamber through pipe 9 producing a +60° F. dew point having 300 ppm molecular oxygen. The strip width was 61 inches, the line speed was 300 fpm and the slot opening was 3 inches. A coated metal strip was obtained containing no edge berries, feathered oxides or spangled relief. A light density zinc vapor was produced.

EXAMPLE 21

Nitrogen gas was injected into the coating chamber through nozzles 5 and no steam was injected through pipe 9 producing an atmosphere within the coating chamber having a dew point of −35° F. and having 90 ppm molecular oxygen. The strip width was 61 inches, the line speed was 300 fpm and the slot opening was 2 inches. Although a coated metal strip was obtained having none of the prior art problems, heavy density zinc vapor was easily visible to the naked eye.

EXAMPLE 22

While nitrogen gas injected through nozzles 5 into the coating chamber, a 30 psi steam was introduced into the coating chamber through pipe 9 producing a +60° F. dew point. The strip width was 61 inches, line speed was 270 fpm and the slot opening was 2 inches. A coated metal strip having none of the prior art problems was produced. A light density zinc vapor was visible.

EXAMPLE 23

As nitrogen gas was injected into the coating chamber through nozzles 5, a 40–120 psi steam was introduced into the coating chamber through pipe 9 producing a dew point of +47° F. having 25 ppm molecular oxygen. The strip width was 35 inches, the line speed was 290 fpm and the slot opening was 2½ inches. A coated metal containing none of the prior art problems was produced. A light density zinc vapor was visible.

EXAMPLE 24

Nitrogen gas was introduced through nozzles 5 into the coating chamber. No steam was introduced through pipe 9. The atmosphere within the coating chamber had a dew point of −49° F. and having 15 ppm molecular oxygen. The strip width was 30 inches, the line speed was 300 ppm and the slot opening was 2½ inches. Although a coated metal strip was obtained having none of the prior art problems, a heavy density zinc vapor was produced.

EXAMPLE 25

While nitrogen gas was introduced into the coating chamber through nozzles 5, a 40–120 psi steam was introduced into the coating chamber through pipe 9 producing a +45° F. dew point and 15 ppm molecular oxygen atmosphere within the coating chamber. The strip width was 39 inches, the line speed was 300 fpm and the slot opening was 2½ inches. A coated metal strip containing no edge berries, feathered oxides or spangled relief was obtained. A light density zinc vapor was produced.

EXAMPLE 26

As nitrogen gas was injected through nozzles 5 into the coating chamber, a 40–120 psi steam was introduced through pipe 9 producing a dew point of +56° F. and molecular oxygen of 15 ppm. The strip width was 31 inches, the line speed was 300 fpm and the slot opening was 2½ inches. A coated metal strip having none of the prior art problems was produced. A very light density zinc vapor was visible.

EXAMPLE 27

As nitrogen gas was introduced into the coating chamber through nozzle 5 a 40–120 psi steam was introduced through pipe 9 producing a +66° F. dew point and 15 ppm molecular oxygen atmosphere in the coating chamber. The strip width was 31 inches, the line speed was 300 ppm and the slot opening was 2½ inches. A coated metal strip containing none of the prior art problems was produced. No zinc vapor was visible.

EXAMPLE 28

While nitrogen gas was introduced into the coating chamber through nozzle 5, a 40–100 psi steam was introduced into the coating chamber through pipe 9 producing an atmosphere having a +30° F. dew point. The strip width was 51 inches, the line speed was 275 fpm and the slot opening was 3½ inches. A coated metal strip was obtained containing no edge berries, feathered oxide or spangled relief. A very light density zinc vapor was produced.

EXAMPLE 29

Nitrogen gas was introduced into the coating chamber through nozzles 5, and a 40–100 psi steam was introduced into the coating chamber through pipe 9 producing a +50° F. dew point and an atmosphere having 15 ppm molecular oxygen. The strip width was 48 inches, the line speed was 250 fpm and the slot opening was 3½ inches. A coated metal strip containing none of the prior art problems was produced. A very light density zinc vapor was visible.

EXAMPLE 30

As nitrogen gas was introduced through nozzles 5 into the coating chamber, a 40–100 psi steam was introduced into the coating chamber through pipe 9 producing a +41° F. dew point and an atmosphere having 150 ppm molecular oxygen. The strip width was 72 inches, the line speed was 245 fpm and the slot opening was 3 inches. A coated metal strip was contained containing no edge berries, feathered oxide or spangled relief. No zinc vapor was visible to the naked eye.

EXAMPLE 31

As nitrogen gas was injected into the coating chamber through nozzles 5, a 40–100 psi steam was introduced into the coating chamber through pipe 9 producing a +45° F. dew point having 150 ppm molecular oxygen. The strip width was 70 inches, the line speed was 251 fpm and the slot opening was 2 inches. A coated metal strip was obtained having none of the prior art problems. A very light density zinc vapor was produced.

Table 1 presents a good summary of the examples and highlights key aspects of the present invention. U.S. Pat. No. 4,369,211 to Nitto et al, disclosed previously, teaches using molecular oxygen to eliminate smoke. Examples 5, 6, 11, 20, 21 and 31 all have relatively large amounts of molecular oxygen present within the atmosphere of the coating chamber. In these examples, the smoke was not eliminated contrary to Nitto et al.

Examples 14 and 15 illustrate the significance of line speed. These examples teach a relatively low line speed and a relatively low steam input thus producing a relatively low dew point and yet no zinc vapor was produced which was visible to the naked eye.

A high line speed coupled with a large steam injection and a narrow strip width produce an atmosphere within the coating chamber having a relatively high dew point. Very little or no zinc vapor is produced under such circumstances as is evidenced by Examples 26 and 27.

Slot opening also has a slight effect upon the density of the zinc vapor. For example, Examples 16 and 29 each have the same dew point and approximately the same line speed and steam input. Example 16 has a slot opening of 1¾ inches while Example 29 has a slot opening of 3½ inches. While Example 16 produced a light density zinc vapor, Example 29 produced a very light density vapor.

TABLE 1

| Example | Strip Width (in.) | Line Speed (F.P.M.) | Slot Opening (in.) | Steam (PSI) | $O_2$ (PPM) | Dewpoint (°F.) | Visible Zinc Emission |
|---|---|---|---|---|---|---|---|
| 1 | 37 | 100 | 3½ | 0 | 15 | −40 | heavy |
| 2 | 70 | 210 | 2 | 10–20 | 40 | +20 | medium |
| 3 | 58 | 240 | 2 | 20–30 | 78 | +38 | lite |
| 4 | 70 | 251 | 2 | 40–100 | 150 | +60 | no smoke |
| 5 | 52 | 300 | 2 | 10–20 | 600 | +62 | lite |
| 6 | 48 | 230 | 2 | 10–20 | 450 | +65 | lite |
| 7 | 52 | 300 | 2 | 10–20 | 55 | +72 | lite |
| 8 | 52 | 300 | 2 | 10–20 | 55 | +65 | lite |
| 9 | 60 | 282 | 2½ | 22–35 | 54 | +29 | lite |
| 10 | 70 | 260 | 2 | 20–30 | 60 | +40 | lite |
| 11 | 70 | 225 | 2 | 10–30 | 150 | +37 | medium |
| 12 | 70 | 225 | 2 | 10–20 | | +42 | lite |
| 13 | 70 | 275 | 2½ | 10–20 | | +23 | lite |
| 14 | 64 | 175 | 2½ | 10–30 | 23 | +20 | none |
| 15 | 64 | 175 | 2½ | 10–30 | 23 | +30 | none |
| 16 | 37 | 270 | 1¾ | 60 | 12 | +50 | lite |
| 17 | 37 | 270 | 1¾ | 20–30 | 20 | +25 | medium |
| 18 | 61 | 300 | 2½ | 20–40 | 100 | +60 | v. lite |
| 19 | 61 | 300 | 3 | 20–40 | 90 | +65 | lite |
| 20 | 61 | 300 | 3 | 20–40 | 300 | +60 | lite |
| 21 | 61 | 300 | 2 | 0 | 90 | −35 | heavy |
| 22 | 61 | 270 | 2 | 30 | | +60 | lite |
| 23 | 35 | 290 | 2½ | 40–120 | 25 | +47 | lite |
| 24 | 30 | 300 | 2½ | 0 | 15 | −49 | heavy |
| 25 | 39 | 300 | 2½ | 40–120 | 15 | +45 | lite |
| 26 | 31 | 300 | 2½ | 40–120 | 15 | +56 | v. lite |
| 27 | 31 | 300 | 2½ | 40–120 | 15 | +66 | none |
| 28 | 51 | 275 | 3½ | 40–100 | | +30 | v. lite |
| 29 | 48 | 250 | 3½ | 40–100 | 15 | +50 | v. lite |
| 30 | 72 | 245 | 3 | 40–100 | 150 | +41 | none |
| 31 | 70 | 251 | 2 | 40–100 | 150 | +45 | v. lite |

Note:
All examples had good to excellent surface appearance on leaving finishing chamber.

What is claimed is:

1. In a process for continuously hot dip coating at least one side of a ferrous base metal strip with a zinc base metal including an enclosure surrounding the coated strip and at least a portion of the zinc base metal coating bath, said enclosure containing an atmosphere having less than about 1000 ppm molecular oxygen, the improvement which comprises injecting and maintaining sufficient high dew point atmosphere having at least about 0.3% water vapor by volume in the enclosure to suppress zinc vapor formation.

2. The improvement of claim 1, wherein said atmosphere has 1% or more water vapor, by volume.

3. The improvement of claim 2, wherein said atmosphere has 3% or less water vapor, by volume.

4. The improvement of claim 1, wherein said atmosphere has 3% or less water vapor by volume.

5. The improvement of claim 1, wherein the high dew point atmosphere is directed away from the ferrous base metal strip, such that the high dew point atmosphere does not impinge upon the strip.

6. The improvement of claim 1, wherein both sides of the ferrous base metal strip are coated.

7. The improvement of claim 1, wherein only one side of the ferrous base metal strip is coated.

8. The improvement of claim 7, wherein the uncoated side of the strip is masked.

9. The improvement of claim 8, wherein the uncoated side of the strip is physically masked.

10. The improvement of claim 8, wherein the uncoated side of the strip is chemically masked.

11. The improvement of claim 1, wherein the high dew point atmosphere is injected into the enclosure by means of one or more nozzles.

12. The improvement of claim 11, wherein the nozzles are directed away from the ferrous base metal strip.

13. The improvement of claim 11, wherein the enclosure has a top with a slot therein to permit the coated ferrous base metal strip to exit the enclosure.

14. The improvement of claim 1, wherein said strip is finished by one or more jet finishing nozzles.

15. The improvement of claim 1, wherein said high dew point atmosphere is non-oxidizing to said ferrous base metal strip.

16. The improvement of claim 1, wherein only one side of said ferrous metal strip is coated.

17. The improvement of claim 1, wherein said atmosphere contains a minimum 4 to 1 $H_2/H_2O$ ratio and preferably a 6 to 1 $H_2/H_2O$ ratio, and wherein water vapor does not exceed 1% by volume.

* * * * *